US008216114B1

(12) United States Patent
Wynn, III

(10) Patent No.: US 8,216,114 B1
(45) Date of Patent: Jul. 10, 2012

(54) ADJUSTABLE EXERCISE PLATFORM

(76) Inventor: Clois M. Wynn, III, Broken Arrow, OK (US)

( * ) Notice: Subject to any disclaimer, the term of this patent is extended or adjusted under 35 U.S.C. 154(b) by 100 days.

(21) Appl. No.: 12/777,338

(22) Filed: May 11, 2010

Related U.S. Application Data

(60) Provisional application No. 61/271,993, filed on Jul. 29, 2009.

(51) Int. Cl.
*A63B 21/00* (2006.01)

(52) U.S. Cl. ..... 482/52; 297/338; 297/423.45; 482/51

(58) Field of Classification Search ..... 482/121, 482/130, 51, 52; 108/147.11; 211/187, 181.1; 248/225.11, 222.51
See application file for complete search history.

(56) References Cited

U.S. PATENT DOCUMENTS

| | | | | | |
|---|---|---|---|---|---|
| 3,606,458 | A | * | 9/1971 | Attinger | 297/423.45 |
| 4,109,961 | A | * | 8/1978 | Opsvik | 297/338 |
| D352,614 | S | * | 11/1994 | Adams | D6/370 |
| D390,713 | S | * | 2/1998 | Chen | D6/367 |
| D517,336 | S | * | 3/2006 | Engelstad | D6/367 |

* cited by examiner

*Primary Examiner* — Jerome W Donnelly
(74) *Attorney, Agent, or Firm* — Molly D. McKay

(57) ABSTRACT

An adjustable height exercise platform device having a platform that is removably secured between a pair of risers. The risers are held upright by an H-shaped horizontal base whose legs extend outward slightly to provide stability to the base. Each riser has spaced apart horizontal slots along its rear side for receiving one of two U-shaped bolts extending upward from the platform. Notches are cut out of the rear edge of the platform so that one of the U-shaped bolts straddles each notch. When the platform is attached to the risers, the U-shaped bolts rest in the slots and the two notches extend around the risers. One or more locking mechanisms are provided on the platform as a means of locking the platform and preventing the platform from being tilted in such a manner as to allow it to disengage from the risers.

7 Claims, 4 Drawing Sheets

ADJUSTABLE EXERCISE PLATFORM

CROSS-REFERENCE TO RELATED APPLICATIONS

The present application claims priority to U.S. Provisional Patent Application Ser. No. 61/271,993 for Height Adjustable Incline/Decline Push Up Platform which was filed on Jul. 29, 2009.

BACKGROUND OF THE INVENTION

1. Field of the Invention

The present invention is a height adjustable platform device for use in exercising. More specifically, the present invention is a stable platform device that can be used in various exercises by placing either the hands or feet on the height adjustable platform.

2. Description of the Related Art

Various devices are employed to allow a person to exercise using a height adjusting device on which to place the person's feet or hands while exercising. These include plyometric boxes, box jumps, and step aerobics steps. Each of these devices has limitations and disadvantages.

Some of these disadvantages include instability and a tendency to tip over when an unbalanced load is applied to the platform, particularly when a sideways pushing force is applied to them. This instability makes these devices undesirable, unsafe, or risky to use with some exercises.

Another disadvantage with prior devices is that some of them have a small top or platform that limits their usage.

Still another disadvantage with prior devices is that some are difficult or time consuming to adjust the height so that the person who is exercising must stop their exercise routine to adjust the height before resuming their exercise repetitions.

Other devices are heavy and cumbersome to lift and adjust the height.

A final disadvantage with prior devices is that some can become dislodged easily from their risers and therefore are unreliable for use in certain exercises.

The present invention addresses all of these problems by providing a device that is extremely stable, even when subjected to sideways pushing forces. It is provided with a large light weight platform that can be easily and quickly adjusted in height so that an exercise routine is virtually uninterrupted by the effort of adjusting the platform height. Also, although the platform is secured in such a way that its height can be adjusted quickly, once the platform is positioned at a given height, it is secure and does not present a danger of becoming dislodged.

The present invention provides a plurality of platform elevations in a singular piece of equipment. It solves the problem of using or stacking ambiguous objects as platforms as well as incurring the monetary expense and exercise time to add/remove individual components or product to raise/lower an exercise platform, or being limited by the functionality of exercise platforms designed for other uses. The platform is designed for simple quick elevation adjustments. Moreover, the present invention is light weight and is easily transportable.

The present invention is designed for performing pushups in an incline or decline position as well as triceps dips in the incline or decline position. When performing a push up, the greater the incline, the less the work load on the targeted muscles. Having a plurality of elevations provides a wider range of resistance levels for those who have weak upper body strength. This is beneficial for those beginning a program for building upper body strength, or for those who have physical limitations that make it difficult to perform pushups on the floor or on other types of horizontal exercise surfaces. A decline push up increases the work load on the targeted muscles. Having a plurality of elevations is beneficial by providing a wider range of resistance levels to further strengthen the targeted muscles. Moreover, the ability to perform an array of incline and decline pushups from a singular piece of equipment with a simple and quick platform elevation adjustment is efficient since there is minimal lost exercise time to change elevations. Additionally, having a plurality of elevation allows the incorporation of muscle confusion into an upper body strength building regimen.

To perform the incline pushup, the exerciser places their hands shoulder width apart on the platform. The platforms edge is rounded and smooth to accommodate a grip, or if desired, one can use push up stands on the platform. The feet are firmly positioned on the ground whereby the arms, when extended to the platform, should be approximately ninety degrees to a flat torso, back and legs. With the back and legs flat from heal to neck, the exerciser lowers their body until the chest approaches the platform. To complete the motion, they push their body back to the start position. To perform a decline push up, the exerciser places their feet on the elevated platform and extends the body straight out with the hands on the floor, shoulder width apart. The body should remain flat without sagging at the torso. The exerciser lowers their body until the chest touches the floor, and then pushes back to the start position. To increase resistance, the exerciser increases the platform elevation. It is notable that the incline and decline pushups allow the exerciser to specifically emphasize work on upper or lower pectoral muscles.

When performing triceps dips, there is more resistance on the targeted muscles as the incline decreases. To perform a triceps dip, the exerciser sits on the platform with palms on the front of the platform. The hands remain on the platform and the hips are moved forward off of the platform with the feet in front of the knees. Using the arms, the body is lowered until the upper arms are parallel to the floor and then returned to the starting position to complete the move. To increase resistance, the feet are elevated on a stability ball, with the platform elevations raised or lowered to create different levels of resistance.

Although the invention has been described for use with a couple of exercises, it is not so limited. The present invention is suitable for use in performing a variety of exercises, for example drop set push-ups, squat therapy, lunges, dips and step aerobics, just to name a few.

SUMMARY OF THE INVENTION

The present invention is an adjustable exercise platform device. The platform is adjustable in height and is intended for use as exercise equipment in the physical fitness or exercise industry. It is designed for performing exercises such as incline and decline pushups and triceps dips which utilize an adjustable exercise platform. The functional feature of the invention is a horizontal height adjustable exercise platform that does not require additional components or objects to raise or lower the exercise platform and that is fast and simple to adjust. It is important to have a quick adjustable platform when performing some routines that require limited rest time between sets.

The platform is intended for use by all persons, regardless of skill or age or level of fitness. Therefore it is equally important that the platform elevation is simple to operate. The platforms edge is rounded and smooth specifically to accommodate a grip from the hands when performing incline push-ups and triceps dip. It is also able to accommodate push up stands. It is light weight and easily transported.

The device is provided with a platform that is adjustably secured between a pair of risers that are held upright by a horizontal base. The horizontal base consist of an H-shaped flat member to which is secured two upright side members and an upright cross member. The legs of the H-shaped flat member extend outward to provide more stability to the base. Each upright side member is secured to the legs on one side of the H-shaped flat member and the upright cross member is secured to the middle horizontal portion of the H-shaped flat member. The upright cross member is secured between the two upright side members such that the lower end of the each riser is received between one of the upright side members and the upright cross member and the lower end rests upon the H-shaped flat member. Each riser is secured to the base with one or more fasteners.

The base engages the ground or floor upon which it rests. The platform, risers, and base may be made of any suitable material, preferably some type of tough, but light weight polymer.

Each riser is provided with spaced apart horizontal notched-out slots along its rear side. The slots are spaced equidistant from top to bottom. The slots are wide enough to accommodate one of the U-shaped bolts provided extending upward on either side of the platform near a rear edge of the platform. The slots are expanded at their innermost part so that once the U-shaped bolts are received in the slots, the u-shaped bolts tend to remain in the innermost expanded portions of the slots which generally help to retain the platform on the risers.

Provided on the platform associated with each U-shaped bolt is a notch that is cut from the platform at the rear edge of the platform so that the U-shaped bolt straddles the cut out notch. When the platform is attached to the risers, the two notches provided in the platform extend around the risers and the U-shaped bolts rest in the slots.

The push up platform is preferably rectangular in shape and at least the front edge and side edges of the platform are somewhat rounded and smooth to prevent injury to the user. One or more locking mechanisms are provided on the platform as a means of preventing the platform from being tilted in such a manner as to allow it to disengage from the risers when the platform is in use.

The platform device is designed to be simple, strong, and durable. It is also designed so that the height, as indicated by the numeral, of the platform is quick and easy to adjust.

To change the platform elevation or height, the locking mechanisms are first opened to allow the platform to be tilted. Then the platform is moved to align the U-shaped bolts with the desired slots before the platform is moved to a horizontal position where the U-shaped bolts engage the slots and the notches fit around the risers. Once the platform is in the desired position, the locking mechanisms are one again closed to prevent the platform from being tilted, thereby securing the platform to the risers.

Optionally, one or more gripping surfaces may be provided on the top surface of the platform to increase the gripping capacity and to prevent the user's hands or feet from accidentally slipping off of the platform when in use.

DETAILED DESCRIPTION OF THE PREFERRED EMBODIMENT

Figure 1:
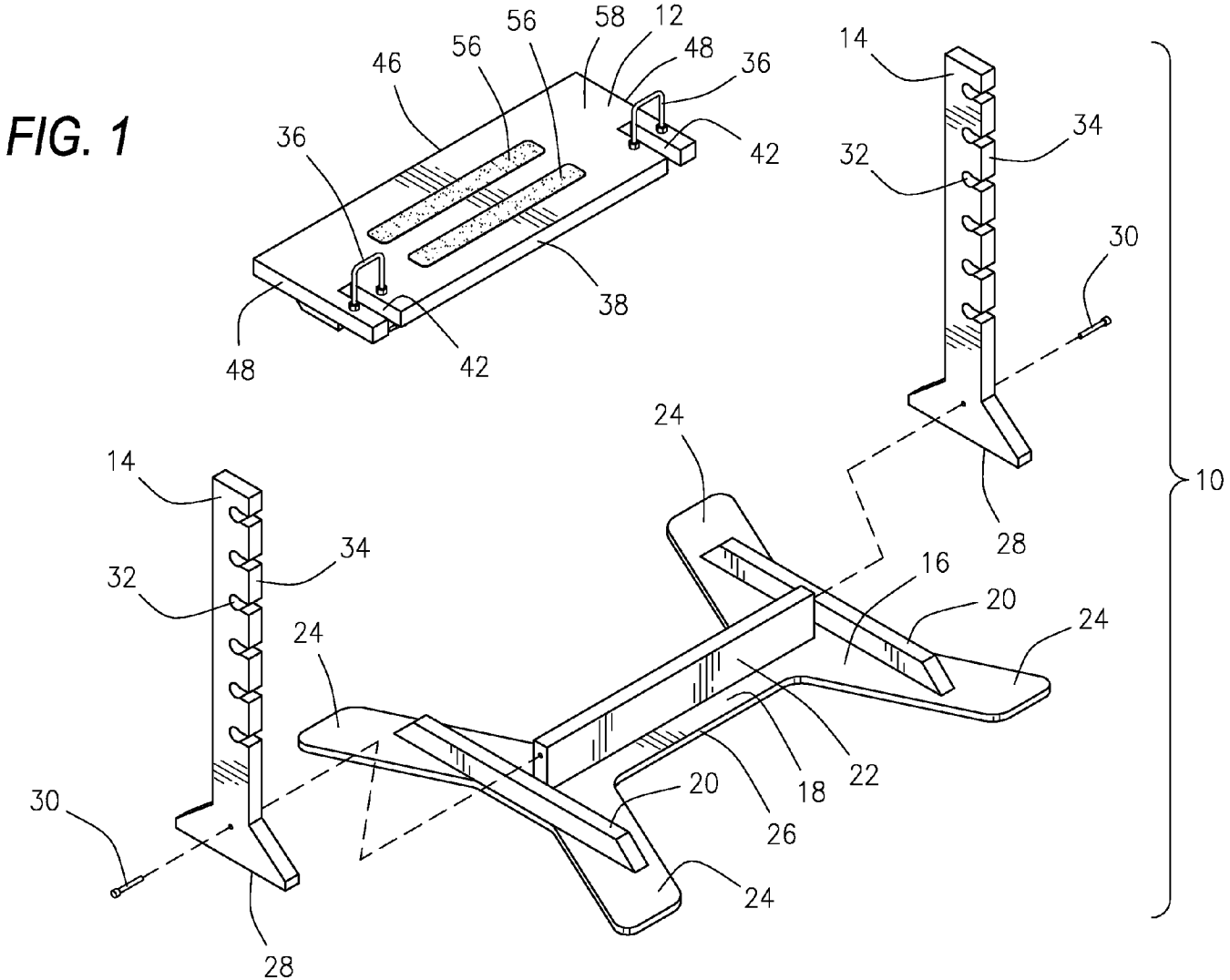
FIG. 1 is an exploded, perspective view of the invention showing the various parts.
Figure 2:
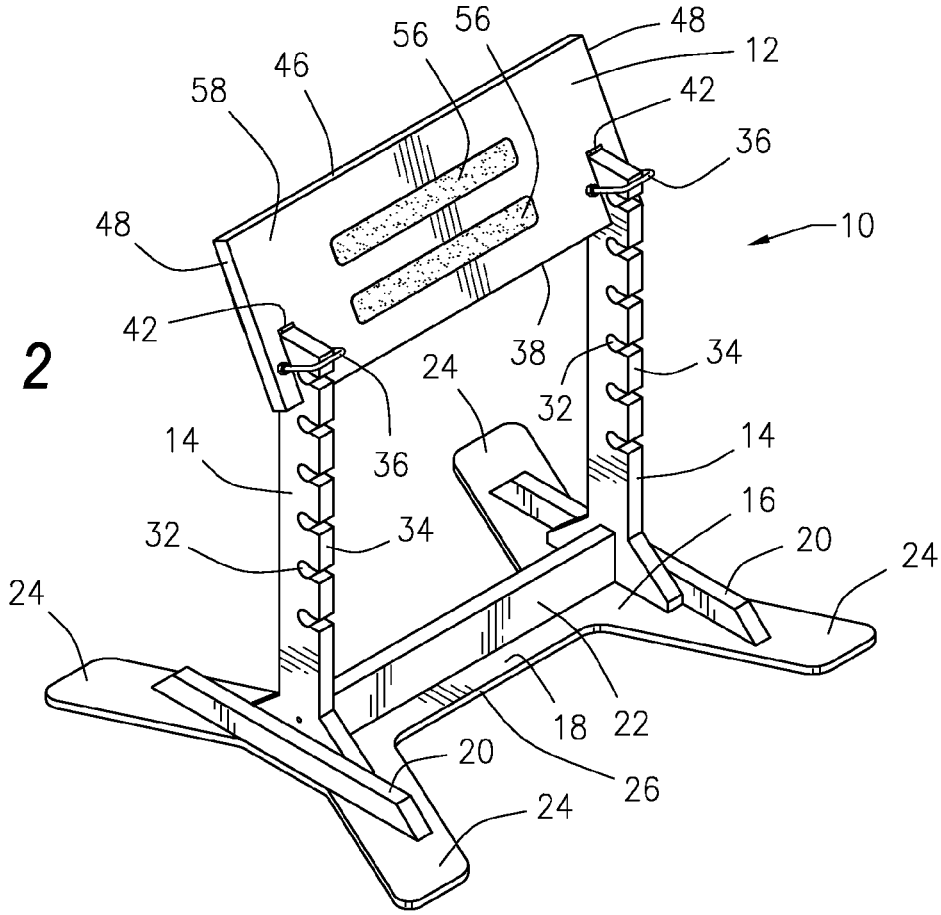
FIG. 2 is a top perspective view of the invention showing the risers attached to the base and with the platform being installed on the risers.
Figure 3:
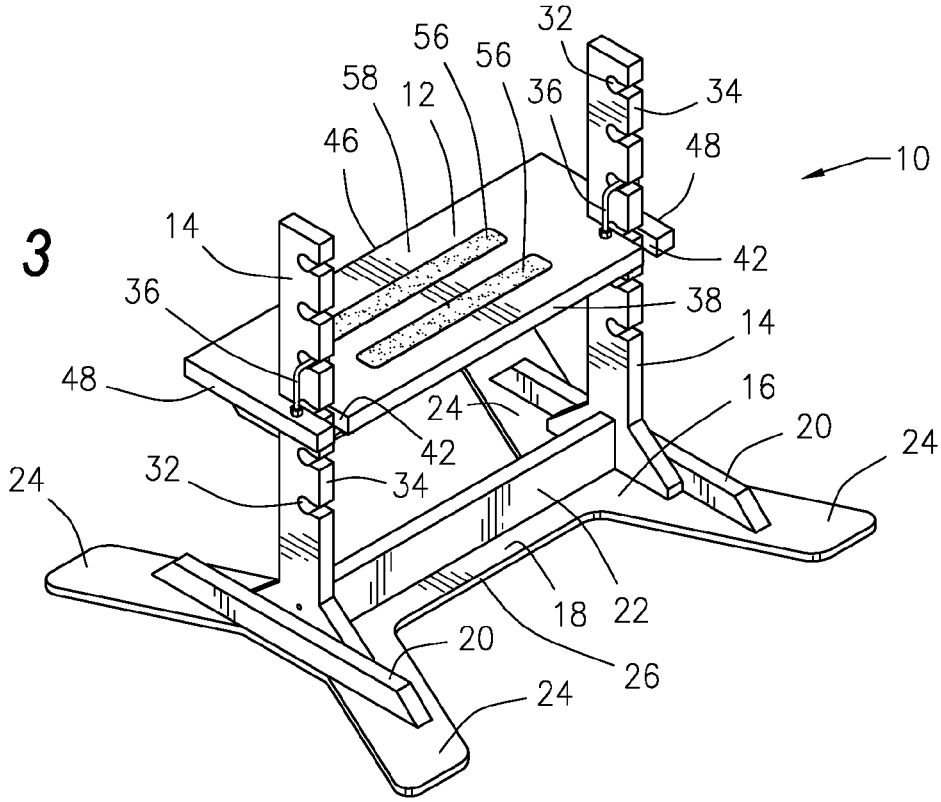
FIG. 3 is a top perspective view of the invention of FIG. 2 showing the platform engaged with the risers.
Figure 5:
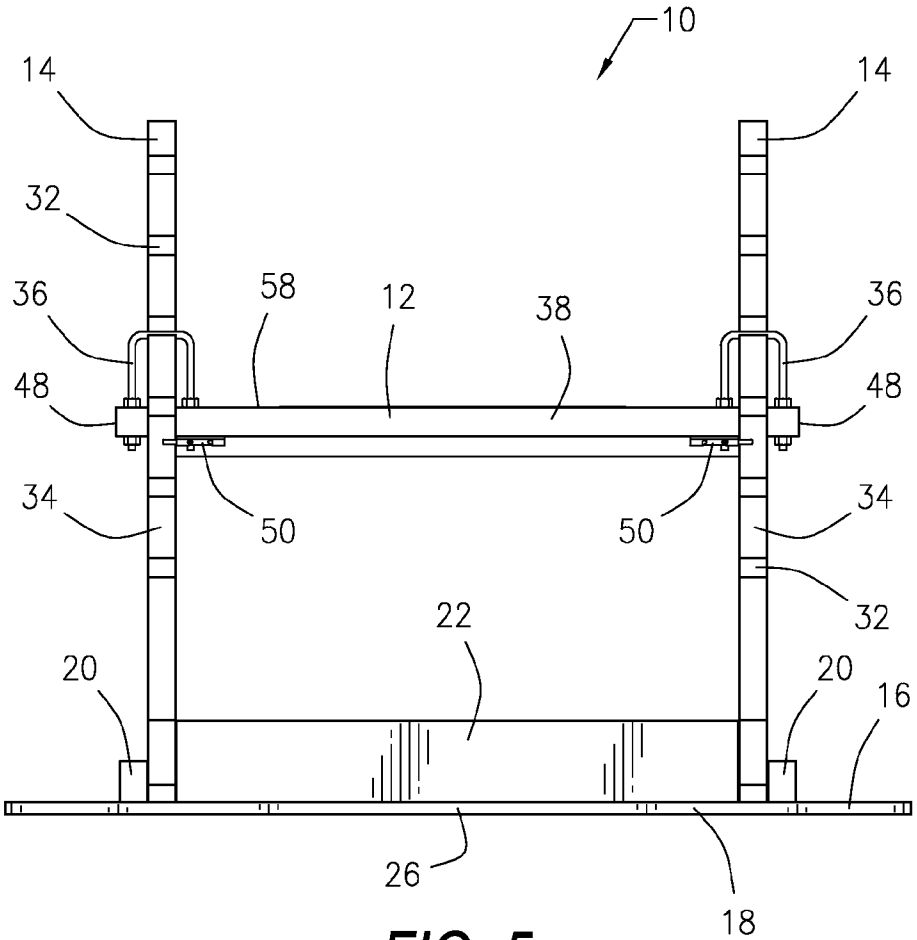
FIG. 5 is a rear plan view of the invention of FIGS. 3 and 4.
Figure 4:
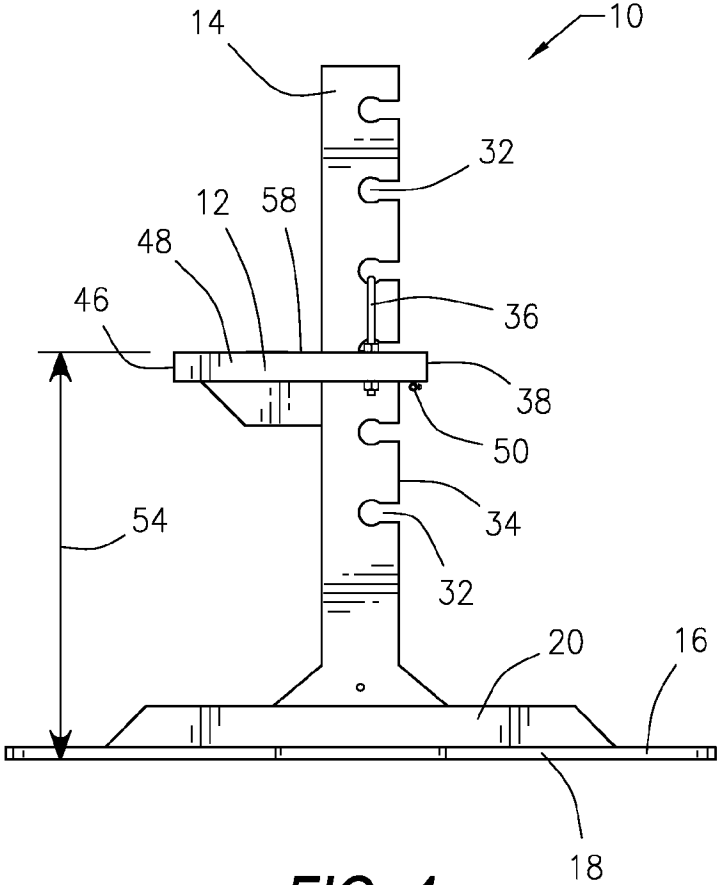
FIG. 4 is right side view of the invention of FIG. 3.

Referring now to FIGS. 1, 2 and 3, there is illustrated an adjustable exercise platform device 10 that is constructed in accordance with a preferred embodiment of the present invention. The device 10 is provided with a platform 12 that is adjustably secured between a pair of risers or column supports 14 that are held upright by a horizontal base 16.

The horizontal base 16 consist of an H-shaped flat member 18 to which is secured two upright side members 20 and an upright cross member 22. The legs 24 of the H-shaped flat member 18 are not in a straight line, but instead extend outward to provide more stability to the base 16 and to keep the device 10 in a stable safe position while in use. Each upright side member 20 is secured to the legs 24 on one side of the H-shaped flat member 18 and the upright cross member 22 is secured to the middle portion 26 of the H-shaped flat member 18. The upright cross member 22 is secured between the two upright side members 20 such that the lower end 28 of the each riser 14 is received between one of the upright side members 20 and the upright cross member 22 and the lower end 28 rests upon the H-shaped flat member 18. Each riser 14 is secured to the base 16 by means of one or more fasteners 30.

The base 16 engages the ground or floor upon which it rests. The platform 12, risers 14 and base 16 may be made of any suitable material, preferably some type of tough, but light weight polymer.

Figure 7:
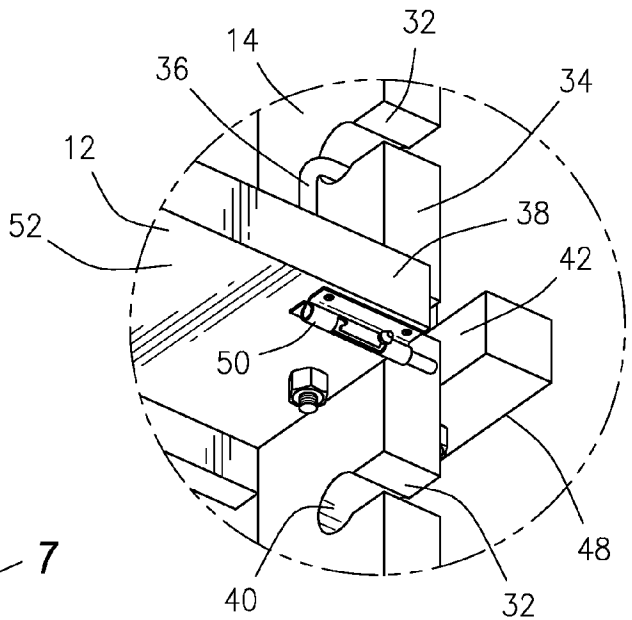
FIG. 7 is an enlargement of the area within circle 7 of FIG. 6 showing in detail the locking mechanism for preventing the platform from becoming disengaged from the risers.
Figure 6:
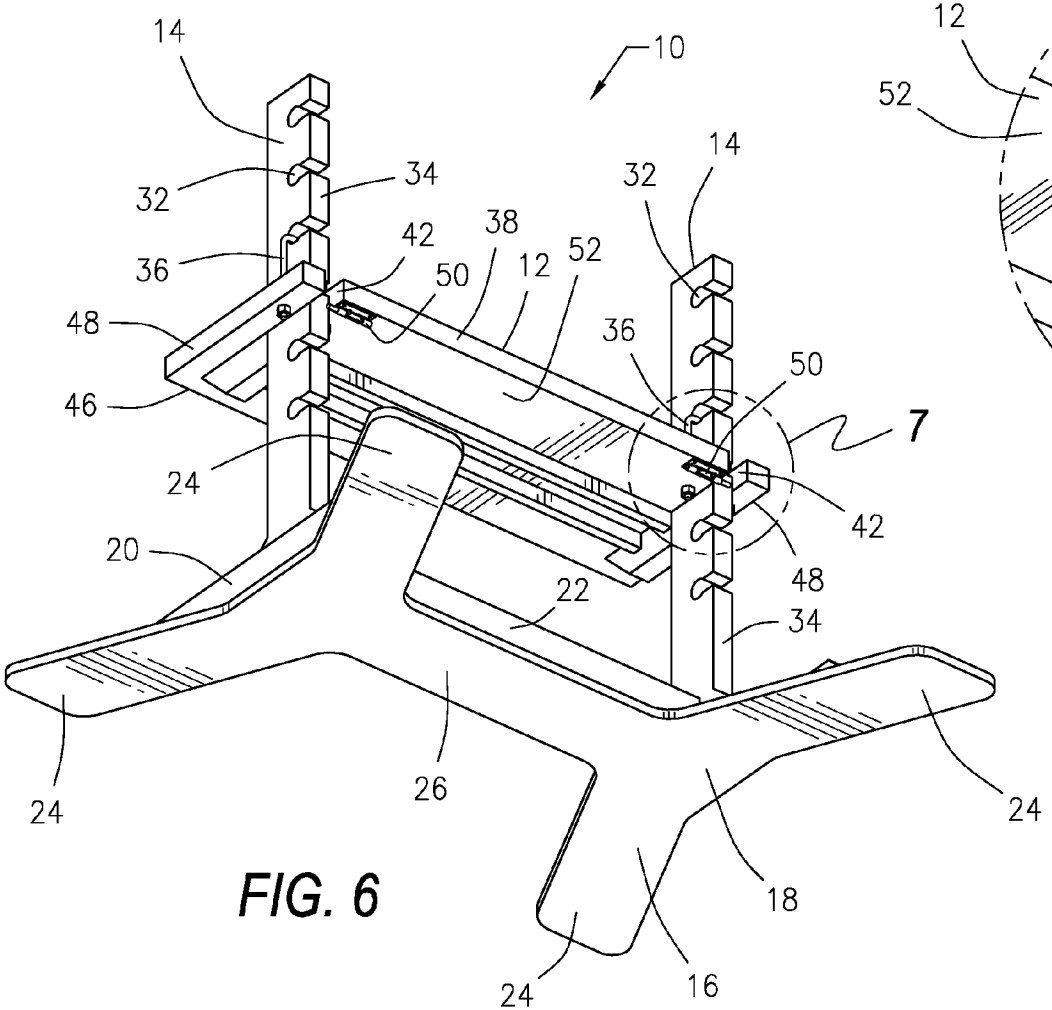
FIG. 6 is bottom perspective view of the invention of FIGS. 3-5

Each riser 14 is provided with spaced apart horizontal notched-out slots 32 along its rear side 34. The slots 32 are spaced equidistant from top to bottom. The slots 32 are wide enough to accommodate one of the U-shaped bolts 36 provided extending upward on either side of the platform 12 near a rear edge 38 of the platform 12. As shown in FIG. 7, the slots 32 are expanded at their innermost part so that once the U-shaped bolts 36 are received in the slots 32, the u-shaped bolts 36 tend to remain in the innermost expanded portions 40 of the slots 32 which generally help to retain the platform 12 on the risers 14.

Provided on the platform 12 associated with each U-shaped bolt 36 is a notch 42 that is cut from the platform 12 at the rear edge 38 of the platform 12 so that the U-shaped bolt 36 straddles the cut out notch 42. When the platform 12 is attached to the risers 14, the two notches 42 provided in the platform 12 extend around the risers 14 and the U-shaped bolts 36 rest in the slots 32, as shown in FIGS. 2-7.

The push up platform 12 is preferably rectangular in shape and at least the front edge 46 and side edges 48 of the platform 12 are somewhat rounded and smooth to prevent injury to the user.

One or more locking mechanisms 50 are provided on the platform 12. As shown in the drawings, the locking mechanisms 50 may be located at the rear edge 38 of the platform 12 on the underside 52 of the platform 12 as a means of preventing the platform 12 from being tilted in such a manner as to allow it to disengage from the risers 14 when the platform 12 is in use. However, the location is not so limited and the locking mechanisms 50 may be of any suitable type and located anywhere on the platform 12 so that they accomplish the desire purpose.

The platform device 10 is designed to be simple, strong, and durable. It is also designed so that the height, as indicated by the numeral 54 in FIG. 4, of the platform 12 is quick and easy to adjust.

To change the platform 12 elevation or height 54, the locking mechanisms 50 are first opened to allow the platform 12 to be tilted, as illustrated in FIG. 2. Then the platform 12 is moved to align the U-shaped bolts 36 with the desired slots 32 before the platform 12 is moved to a horizontal position where the U-shaped bolts 36 engage the slots 32 and the notches 42 fit around the risers 14. Once the platform 12 is in the desired position, the locking mechanisms 50 are one again closed to prevent the platform 12 from being tilted, thereby securing the platform 12 to the risers 14.

Optionally, one or more gripping surfaces 56 may be provided on the top surface 58 of the platform 12 to increase the gripping capacity and to prevent the user's hands or feet from accidentally slipping off of the platform 12 when in use.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. An adjustable height exercise platform device comprising:

a platform removably securable between a pair of upright spaced apart risers, U-shaped bolts secured to and extending upward from the platform, each riser provided with spaced apart horizontal slots for receiving one of the U-shaped bolts, and notches provided in the platform, one of said U-shaped bolts straddling each notch so that the U-shaped bolts rest in the slots of the risers and the notches in the platform extend around the risers when the platform is secured to the risers.

2. An adjustable height exercise platform device according to claim 1 further comprising:

each said riser secured at its lower end to an H-shaped horizontal base whose legs extend outward to provide stability to the base.

3. An adjustable height exercise platform device according to claim 1 wherein said spaced apart horizontal slots are provided along the rear side of each riser.

4. An adjustable height exercise platform device according to claim 3 wherein said notches are provided in the rear edge of the platform.

5. An adjustable height exercise platform device according to claim 1 further comprising:

at least one locking mechanism provided on the platform to lock the platform to the risers and prevent it from being tilted in such a manner as to allow it to disengage from the risers.

6. An adjustable height exercise platform device according to claim 5 wherein each said locking mechanisms is provided on the rear of the platform so that the locking mechanisms engage the risers when locked.

7. An adjustable height exercise platform according to claim 1 further comprising:

at least one gripping surface attached to the top side of the platform.

* * * * *